US006899794B1

(12) United States Patent
Yamada et al.

(10) Patent No.: US 6,899,794 B1
(45) Date of Patent: May 31, 2005

(54) SPEAKER DEVICE, AND METHOD AND DEVICE FOR PRODUCING THE SAME

(75) Inventors: Teruho Yamada, Tokyo (JP); Masahiko Kawahara, Osaka (JP); Yukio Sugimoto, Shizuoka (JP); Seiji Mori, Tokyo (JP); Toshikazu Iwasaki, Tokyo (JP)

(73) Assignees: Mitsubishi Denki Kabushiki Kaisha, Tokyo (JP); Morito Co., Ltd., Osaka (JP); Fuji Cone Seisakusho Co., Ltd., Shizuoka (JP); Foster Electric Co., Ltd., Tokyo (JP)

( * ) Notice: Subject to any disclaimer, the term of this patent is extended or adjusted under 35 U.S.C. 154(b) by 91 days.

(21) Appl. No.: 10/148,237

(22) PCT Filed: Oct. 6, 2000

(86) PCT No.: PCT/JP00/06999

§ 371 (c)(1),
(2), (4) Date: May 28, 2002

(87) PCT Pub. No.: WO02/32187

PCT Pub. Date: Apr. 18, 2002

(51) Int. Cl.[7] ..... D21F 13/00

(52) U.S. Cl. ..... 162/219; 162/221; 162/228; 162/231; 162/382; 162/383; 162/389; 162/390; 162/409; 264/86; 264/87; 425/84; 425/85

(58) Field of Search ..... 162/219, 221, 162/222, 227, 228, 231, 382, 383, 387, 388, 162/389, 390, 409, 411; 425/84, 85; 264/86, 264/87

(56) References Cited

U.S. PATENT DOCUMENTS

| | | | | |
|---|---|---|---|---|
| 2,411,066 | A * | 11/1946 | Stevens | 162/409 |
| 2,460,129 | A * | 1/1949 | Ista | 162/409 |
| 2,549,138 | A * | 4/1951 | Stevens | 181/169 |
| 4,291,781 | A * | 9/1981 | Niguchi et al. | 181/169 |
| 5,875,253 | A * | 2/1999 | Okazaki et al. | 381/396 |
| 6,371,241 | B1 * | 4/2002 | Yamada et al. | 181/171 |

FOREIGN PATENT DOCUMENTS

| | | |
|---|---|---|
| JP | 57-84700 A | 5/1982 |
| JP | 58-11388 U | 1/1983 |

* cited by examiner

*Primary Examiner*—Peter Chin
(74) *Attorney, Agent, or Firm*—Birch, Stewart, Kolasch & Birch, LLP

(57) ABSTRACT

A liquefied paper material is used as raw materials. A paper frame member 1 supporting a vibrating plate is paper-skimmed and formed. On paper-skimming and forming, a central hole for use in voice coils, air-release hole 1*a* releasing air pressure in a rear of the vibrating plate to outside due to vibration of the vibrating plate. A loudspeaker system is manufactured using the paper frame member 1.

13 Claims, 13 Drawing Sheets

SPEAKER DEVICE, AND METHOD AND DEVICE FOR PRODUCING THE SAME

TECHNICAL FIELD

The invention relates to a loudspeaker system, a method and an apparatus of manufacturing the same.

BACKGROUND ART

FIG. 1 is across sectional view of a conventional loudspeaker system. In the figure, a reference numeral 51 denotes a frame member made of a metal plate, 52 denotes an upper plate, 52*a* denotes a dowel (projection) formed on the upper plate 52, 53 denotes a pole-piece, and 54 denotes a magnet. A reference numeral 55 denotes a bobbin, 55*a* denotes a voice coil fixed in a state of being wound around the bobbin 55, 56 denotes a gasket, 57 denotes a mounting screw, 58 denotes a vibrating plate, and 58*a* denotes a center cap of the vibrating plate 58. A reference numeral 59 denotes an edge, 60 denotes a damper section, 61 denotes a terminal block, 62 denotes a terminal, 63 denotes a gold string wire, and 64 denotes an air gap. FIG. 2 is a plan view of construction of the frame member 51 shown in FIG. 1. In the figure, 51*a* denotes eight windows arranged in a circle, 51*b* denotes a central hole for use in accommodating the voice coil 55*a*, and 51*c* denotes four holes for use in allowing insertion of the dowel 52*a* of the upper plate 52. A reference numeral 51*d* denotes four holes for use in allowing insertion of the mounting screws 57, 5*le* denotes a notch, and 51*f* denotes a long hole.

When the conventional loudspeaker system is assembled, the four dowels 52*a* of the upper plate 52 are inserted into the four holes 51*c* of the frame member 51, and then their tops of the dowels 52*a* are crushed (swaged) due to plastic deformation processing. In this way, the frame member 51 is held to the upper plate 52. The magnet 54 is sandwiched and fixed between the upper plate 52 and the pole-piece 53 due to adhesive. An inner periphery of a central hole of the disc-shaped damper section 60 is bonded to the bobbin 55, and an outer periphery of the damper section 60 is bonded to the frame member 51. An inner periphery of a central hole of the vibrating plate 58 is also bonded to the bobbin 55, and an outer periphery of the vibrating member 58 is bonded to the frame member 51 through the edge 59. The center cap 58*a* is mounted to a central section of the vibrating member 58. A cylindrical-shaped bobbin 55 around which the voice coil 55*a* is wound is movably inserted into the air gap 64 as a gap defined between a rod-shaped pole of the pole-piece 53 and a hole of the upper plate 52. Moreover, the terminal 62 is fixed to the terminal plate 61 due to a grommet and so on, and a lead wire supplying electric signals to the terminal 62 is soldered thereto.

Next, an operation will be explained.

Electric signals (acoustical signals) inputted to the terminal 62 is supplied to the voice coil 55*a* through the gold string wires 63. The voice coil 55*a* produces a magnetic flux in response to the electric signals and a mechanical displacement due to the interaction with a magnetic circuit including the upper plate 52, the pole-piece 53 and the magnet 54. In other words, the bobbin 55 integrated with the voice coil 55*a* vibrates (in up-and-down directions on a paper of FIG. 1) in response to the supplied electric signals. The vibrating plate 58 vibrates due to the vibration of the voice coil 55*a*, and produces sound due to change in air pressure based on the vibration.

The damper section 60 has the function of braking free vibration of the vibrating plate 58. The eight windows 51*a* arranged in the frame member 51 have the function of releasing air pressure, which is generated between the vibrating plate 58 and the frame member 51 due to the vibration of the voice coil 55*a*, to outside. When the damper section 60 brakes improperly the free vibration of the vibrating plate 58, unclear-cut sound is produced. When the windows 51*a* are not formed, small sound is produced. Therefore, an area of the window 51*a* of the frame member 51 exerts direct influence upon sound quality and level. With the metal frame member 51 shown in FIG. 2, the windows 51*a* are formed due to presswork.

Furthermore, the notch 51*e* and the long hole 51*f* have the function of absorbing a mechanical distortion, which occurs when the loudspeaker system is mounted. For example, when the loudspeaker system is mounted on an unevenness location in a vehicle, portions enclosing the notch 51*e* and the long hole 51*f* are deformed on securing with screws to contain the distortion of the frame member 51 in a local periphery of the hole 51*d*. Therefore, an axis of the voice coil 55*a* is kept precisely without deviating from a center of rotation.

Since the conventional loudspeaker system is constructed as described above, it has the following problems.

Firstly, there are defects of the metal frame member that the frame member 51 has a tendency to produce a self-resonance when the vibrating plate 7 in response to the acoustic signals and that a self-resonance frequency enters into the audio-frequency region. Since the self-resonance occurs due to vibration out of the outside of the loudspeaker system, the frame member has a tendency to especially produce the self-resonance when the system is mounted on the vehicle.

For example, with 13 cm-bore loudspeaker system using a frame member made of aluminum plate in 0.7 mm thickness, a self-resonance frequency of the frame member is concentrated close to 1.5 kHz as audible frequencies. Therefore, since sounds generated due to the self-resonance of the frame member is mixed to sound produced due to the vibrating plate, there is a problem that sound quality is impaired remarkably.

As measures against the impairment of the sound quality, there is the idea of increasing the weight of the frame member. For example, since a zinc-casting frame member can prevent its self-resonance from exerting an influence upon sound quality, it is used especially to a large loudspeaker system for home and commercial use. Moreover, a press-worked frame member made of a thickened metal plate also can prevent its self-resonance from exerting an influence upon sound quality.

However, since expensive press machines and stamping dies need for press-working the metal frame member, there is a problem that the cost of manufacturing is inherently high. There is a problem that the zinc-casting frame member results in further increasing the cost of manufacturing because of needs for many stages in secondary processing to obtain the frame member in a required form. Moreover, there is a problem that the thickened metal frame member results in increasing the cost of manufacturing due to materials cost.

Furthermore, when the weight of the frame member is increased, the shape of the loudspeaker system becomes larger. Especially, when the system is mounted on a vehicle, it is difficult to mount the system thereon because of the limit of space for mounting the system thereon. Moreover, when many systems having the frame member weighed are mounted thereon, the design cannot be adopted because of increasing the weight of the vehicle.

Secondarily, the metal frame member is made of quite iron material in respects of materials cost and machinability. Since the iron-made frame member is however ferromagnetic substance, there is a problem of reducing efficiency because of magnetic flux leaked from magnetic circuits.

Third, there are defects of the metal frame member that the cost of discarding and disposing rises due to environmental protection when the loudspeaker system is disposed because of replacement or breakage of parts. In order to protect environment when industry products are disposed generally, ways for reuse or recycle and disposition without environmental destruction are considered. With the loudspeaker system, it is difficult to recycle the system under present circumstances, and a majority of parts in the system is disposed. On disposition of the parts, there is a need to divide the system into parts.

With one example of the loudspeaker system shown in FIG. 1, the frame member 51 is however held to the upper plate 52 due to swaging. Therefore, it is very difficult to carry out divisional works and it takes much time to do it. Expenses involved in the divisional works, labor costs and working time result in increasing the cost of disposition. This becomes an economical factor that leads up to increasing of the cost of new products or a vicious cycle.

On the other hand, in order to facilitate separation between the parts of the system, there is the idea of using the frame member made from resin-forming materials. Under the current household electrical appliance recycling law, since the resin materials is out of target for recycling, divided resin materials are wasted in soil. The resin materials are not decomposed semi-permanently because a secular variation of the resin materials in soil and water is smaller than that of metal materials. There are problems of not protecting environment.

Fourthly, the metal and resin-made frame member possesses high stiffness. With the loudspeaker system for use in being mounted on the vehicle, there are problems that it is difficult to perform mounting works because the system is mounted on an evenness face and because impediments such as various kinds of projections are arranged at locations where the system is mounted.

The invention was made to solve the foregoing problems. Accordingly, it is an object of the invention to provide a loudspeaker system having the outstanding acoustic characteristics without loss of sound quality because of self-resonance of the frame member occurred due to vibration of the vibrating plate.

A further object of the invention is to provide an inexpensive loudspeaker system manufactured at a low cost.

A still further object of the invention is to provide an efficiency-enhancing loudspeaker system reducing magnetic flux leaked from magnetic circuits to the frame member.

An another object of the invention is to provide a cost-reduction loudspeaker system, which facilitates to separate from parts when the loudspeaker system is disposed.

A further object of the invention is to provide a high endurance loudspeaker system usable during a long period of time, the system reducing discarding frequency to protect environments.

A still further object of the invention is to provide a loudspeaker system facilitating performing mounting works.

An another object of the invention is to provide a loudspeaker system having a high degree of flexibility in design of the system.

A further object of the invention is to provide a loudspeaker system solving various kinds of problems concerned with respect to use of a paper frame member.

DISCLOSURE OF THE INVENTION

In order to achieve the object of the invention, we provide a loudspeaker system comprising a vibrating plate producing sound due to change in air pressure based on vibration; and a paper-skimmed and formed paper frame member supporting the vibrating plate in a rear direction of the vibrating plate and having a hole releasing air pressure in a rear of the vibrating plate to outside due to vibration of the vibrating plate.

In the loudspeaker system according to the invention, one or both of sides of the paper frame member may be surface-processed with resin films.

In the loudspeaker system according to the invention, the paper frame member may contain thermoplastic resin fibers.

In the loudspeaker system according to the invention, the paper frame member is welded to a resin magnet.

In the loudspeaker system according to the invention, the paper frame member may be paper-skimmed and formed using foaming paper materials.

In the loudspeaker system according to the invention, the paper frame member and a damper section braking vibration of the vibrating plate may be paper-skimmed and formed in one piece.

In the loudspeaker system according to the invention, one or both of sides of the paper frame member may be labeled with a paper made reinforced member.

In the loudspeaker system according to the invention, the paper frame member may include a plurality of regions formed close to edges of the frame member, a central section, linear thinned sections allowing bending of the frame member formed between the respective regions and the central section, and mounting holes formed at the respective regions.

In the loudspeaker system according to the invention, the paper frame member may include a plurality of regions formed close to edges of the frame member, a central section, a thinned section allowing bending of the frame member formed between the respective regions and the central section, and a pair of mounting holes being symmetrical about the thinned section.

In the loudspeaker system according to the invention, the paper frame member may include a plurality of regions formed close to edges of the frame member, a central section, a plurality of pores in rows tearing between the regions and the central section.

In the loudspeaker system according to the invention, the pores in rows may be arranged in concentric shapes and/or in radial shapes.

In the loudspeaker system according to the invention, the paper frame member may include a plurality of mounting holes, and wherein a plurality of slits are arranged in radial shapes at inner peripheries of the respective mounting holes.

In order to achieve the object of the invention, we provide a method of manufacturing a loudspeaker system, comprising the steps of: a first step of bringing auxiliary mold into contact with a part of a forming surface in a frame-forming mold for paper-skimming and forming a frame member of a loudspeaker system; a second step of adhesion of liquefied paper material having a water content to a section other than a section making contact with the auxiliary mold in the forming surface of the frame-forming mold; a third step of removing water from the liquefied paper material adhered to the forming surface of the frame-forming mold; and a fourth step of heating and drying the water-removed paper material to form a paper frame member.

In a method of manufacturing a loudspeaker system according to the invention, it may further comprise the step of surface-treating one or both of sides of the paper frame member, which is formed at the fourth step, with resin films.

In a method of manufacturing a loudspeaker system according to the invention, it may further comprise the step of mixing thermoplastic resin fibers into the liquefied paper material prior to the second step.

In a method of manufacturing a loudspeaker system according to the invention, it may further comprise the steps of: bringing a part of the paper frame member, which has one or both of sides surface-processed with the thermoplastic resin film or is mixed with the thermoplastic resin fibers, into contact with a part of a resin magnet; and heating the contact sections to weld both sections together.

In a method of manufacturing a loudspeaker system according to the invention, the liquefied paper material, which is made from foaming paper materials, may be foamed in the fourth step.

In a method of manufacturing a loudspeaker system according to the invention, a damper section braking vibration of the vibrating plate in a loudspeaker system may be formed in one piece at a central section of the paper frame member.

In a method of manufacturing a loudspeaker system according to the invention, it may further comprise the step of labeling one or both of sides of the paper frame member with a paper made reinforced member.

In a method of manufacturing a loudspeaker system according to the invention, linear thinned sections, which allow bending of the paper frame member, may be formed close to mounting holes on forming the paper frame member.

In a method of manufacturing a loudspeaker system according to the invention, it may further comprise linear thinned sections, which allow bending of the paper frame member, may be formed at a midpoint between a pair of mounting holes on forming the paper frame member.

In a method of manufacturing a loudspeaker system according to the invention, a plurality of pores in rows may be formed between a plurality of regions, which are formed close to edges of the paper frame member, and a central section of the paper frame member on forming the paper frame member.

In a method of manufacturing a loudspeaker system according to the invention, the pore in rows may be formed in concentric shapes and/or in radial shapes.

In a method of manufacturing a loudspeaker system according to the invention, a plurality of slits may be formed in radial shapes at inner peripheries of mounting holes to be formed.

In a method of manufacturing a loudspeaker system according to the invention, the second step may comprise the steps of lifting a first accommodation means accommodating the liquefied paper material, and feeding the liquefied paper material into a second accommodation means connected to the first accommodation means through a communication pipe to immerse the auxiliary mold and the frame-forming mold in the second accommodation means into the liquefied paper material, and the third step may comprise the steps of lowering the first accommodation means so that the liquefied paper material reaches a position lower than an adhering face defined by the liquefied paper material and the frame-forming mold; and removing water from the liquefied paper material adhered to the frame-forming mold.

In order to achieve the object of the invention, we provide an apparatus of manufacturing a loudspeaker system, comprising a frame-forming mold for paper-skimming and forming a frame member of a loudspeaker system; an auxiliary mold having a plurality of projections; a first controlling means bringing the projections of the auxiliary mold into contact with a forming surface of the frame-forming mold; a second controlling means controlling an adhesion of liquefied paper material having a water content to a section other than a section making contact with the auxiliary mold in the forming surface of the frame-forming mold; a third controlling means removing water from the liquefied paper material adhered to the forming surface of the frame-forming mold; and a fourth controlling means heating and drying the water-removed paper material to form a paper frame member.

In an apparatus of manufacturing a loudspeaker system according to the invention, the frame-forming mold and the auxiliary mold each may have shapes, which are adequate for paper-skimming and forming a damper section, which brakes vibration of the vibrating plate in a loudspeaker system, and the frame member in one piece.

In an apparatus of manufacturing a loudspeaker system according to the invention, the auxiliary mold maintained contact with the frame-forming mold may have a shape adequate for forming linear thinned sections allowing bending of the paper frame member between a plurality of regions formed close to edges of the frame member and a central section and for forming mounting holes at the respective regions.

In an apparatus of manufacturing a loudspeaker system according to the invention, the auxiliary mold maintained contact with the frame-forming mold may have a shape adequate for forming a thinned section between a plurality of regions formed close to edges of the paper frame member and a central section and for forming a pair of mounting holes symmetrical about the thinned section.

In an apparatus of manufacturing a loudspeaker system according to the invention, the auxiliary mold maintained contact with the frame-forming mold may have a shape adequate for forming a plurality of pores in rows a plurality of regions formed close to edges of the paper frame member and a central section.

In an apparatus of manufacturing a loudspeaker system according to the invention, the auxiliary mold may have a shape adequate for forming the pores in concentric shapes and/or in radial shapes.

In an apparatus of manufacturing a loudspeaker system according to the invention, the auxiliary mold maintained contact with the frame-forming mold may have a shape adequate for forming a plurality of mounting holes in the paper frame member and for forming in radial shapes a plurality of slits at inner peripheries of the respective mounting holes.

In an apparatus of manufacturing a loudspeaker system according to the invention, it may further comprise a first accommodation means accommodating liquefied paper material; a second accommodation means accommodating a frame-forming mold and an auxiliary mold; a communication pipe connecting the first accommodation means to the second accommodation means; and an up-and-down controlling means raising or lowering the first accommodation means.

In an apparatus of manufacturing a loudspeaker system according to the invention, it may further comprise a surface-treatment means treating one or both of sides of the paper frame member, which is paper-skimmed and formed, with resin films.

In an apparatus of manufacturing a loudspeaker system according to the invention, it may further comprise a label-treatment means labeling one or both of sides of the paper frame member with a paper made reinforced member.

BEST MODES FOR CARRYING OUT THE INVENTION

To explain the invention more in detail, the best modes of carrying out the invention will be described with reference to the accompanying drawings.

Embodiment 1

Figure 1:
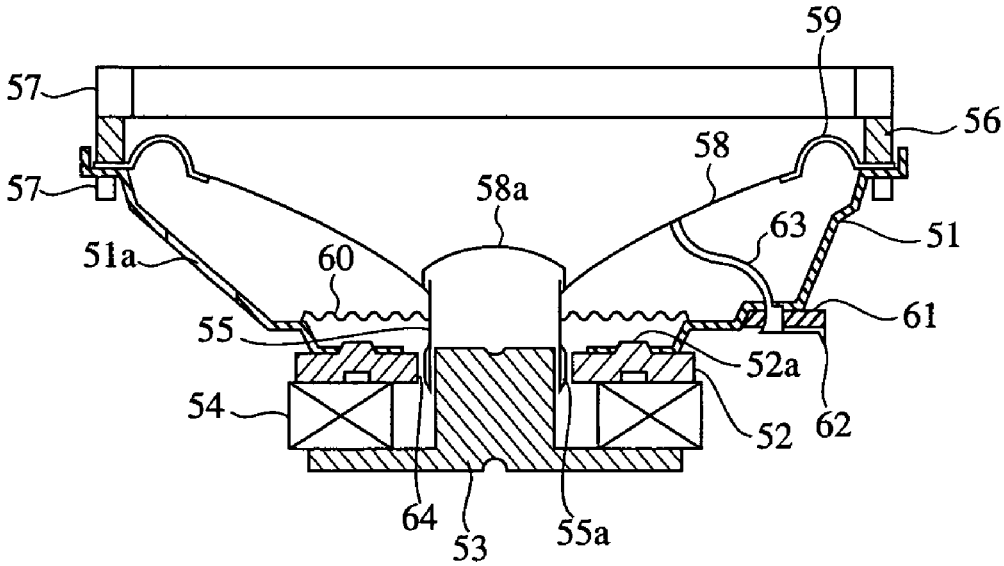
FIG. 1 is a cross sectional view of a conventional loudspeaker system.
Figure 2:
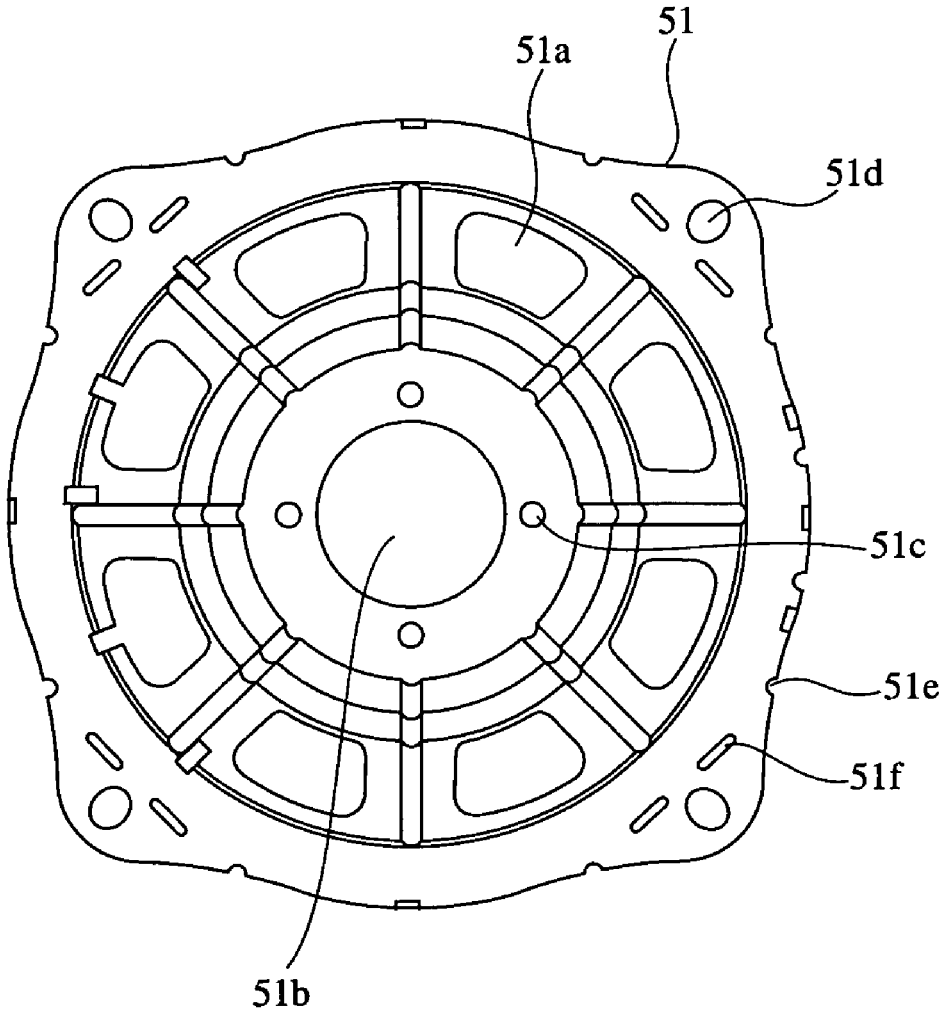
FIG. 2 is a plan view of a frame member shown in FIG. 1.
Figure 3:
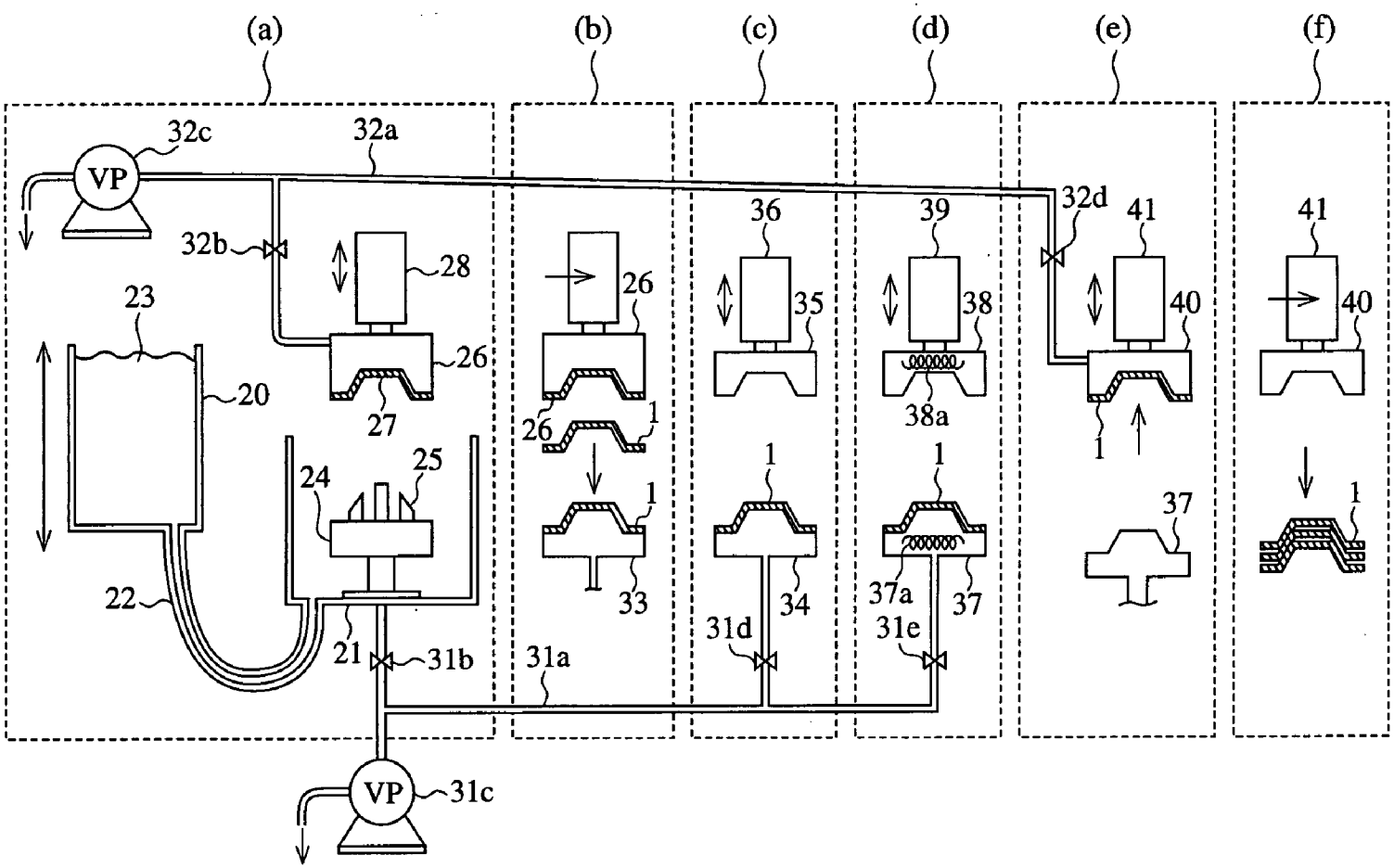
FIG. 3 is a view of a manufacturing process performed using apparatus of manufacturing a loudspeaker system as embodiment 1 according to the invention.

FIG. 3 is a view of a manufacturing process performed using apparatus of manufacturing a loudspeaker system as embodiment 1 according to the invention. In the figure, (a) denotes a paper-skimming process, (b) denotes a skimmed paper-receiving process, (c) denotes a water-removing, forming process, (d) denotes a hot forming process, (e) denotes a product-removing process, and (f) denotes a product-accommodating process.

With the paper-skimming process, reference numerals 20 and 21 denote paper-skimming baths (first and second accommodation means) for performing paper-skimming process. A reference numeral 22 denotes paper-material supply pipe (communication pipe) for connecting the paper-skimming bath 20 to the paper-skimming bath 21. A reference numeral 23 denotes liquefied paper material having a water content, and 24 denotes a paper-skimming lower half-mold (auxiliary mold) mounted within the paper-skimming bath 21. A reference numeral 25 denotes projections, which are called mask-plate, of the lower half-mold 24, 26 denotes a paper-skimming upper half-mold (frame-forming mold), and 27 denotes metal-screen mold (frame-forming mold) mounted on the upper half-mold 26. A reference numeral 28 denotes a hydraulic cylinder raising or lowering the upper half-mold 26, and 31*a* and 32*a* each denote drain-pipes shared between another processes. A reference numeral 31*b* denotes a stop valve of the drain-pipe 31*a* connected to the lower half-mold 24, and 32*b* denotes a stop valve of the drainpipe 32*a* connected to the upper half-mold 26. Reference numerals 31*c* and 32*c* each denote vacuum pumps connected to the drainpipes 31*a* and 32*a*. Moreover, the drainpipe 32*a* is connected to a conduit 26*a* formed in the upper half-mold 26.

With the skimmed paper-receiving process (b), a reference numeral 33 denotes a carrying lower half-mold. With the water-removing, forming process (c), a reference numeral 34 denotes a water-removing lower half-mold, and 31*d* denotes a stop valve of the drainpipe 31*a* connected to the water-removing lower half-mold 34. A reference numeral 35 denotes a water-removing upper half-mold, and 36 denotes a hydraulic cylinder raising or lowering the water-removing upper half-mold 35. With the hot forming process (d), a reference numeral 37 denotes a hot-disk lower half-mold, 37*a* denotes a heater arranged within the hot-disk lower half-mold 37, 31*e* denotes a stop valve of the drain-pipe 31*a* connected to the hot-disk lower half-mold 37. A reference numeral 38 denotes a hot-disk upper half-mold, 38*a* denotes a heater arranged within the hot-disk upper half-mold 38, and 39 denotes a hydraulic cylinder raising or lowering the hot-disk upper half-mold 38. With the product-removing process (e), a reference numeral 40 denotes an adsorption upper half-mold, 41 denotes a hydraulic cylinder raising or lowering the adsorption upper half-mold 40, and 32*d* denotes a stop valve of the drainpipe 32*a* connected to the adsorption upper half-mold 40.

Moreover, with the skimmed paper-receiving process (b), the water-removing, forming process (c), the hot forming process (d), and the product-accommodating process (f), a reference numeral 1 denotes a paper frame member paper-skimmed and formed in the paper-skimming process (a).

Figure 4A:
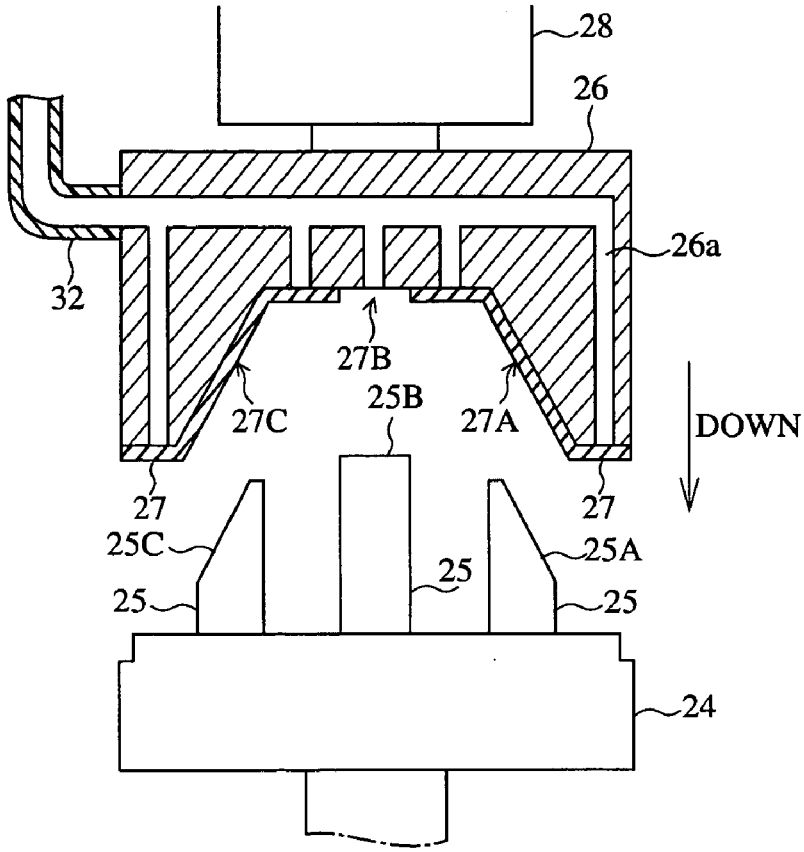
FIG. 4A is a cross sectional view of an upper half-mold and a lower half-mold used in a paper-skimming process performed using the apparatus shown in FIG. 3.
Figure 4B:
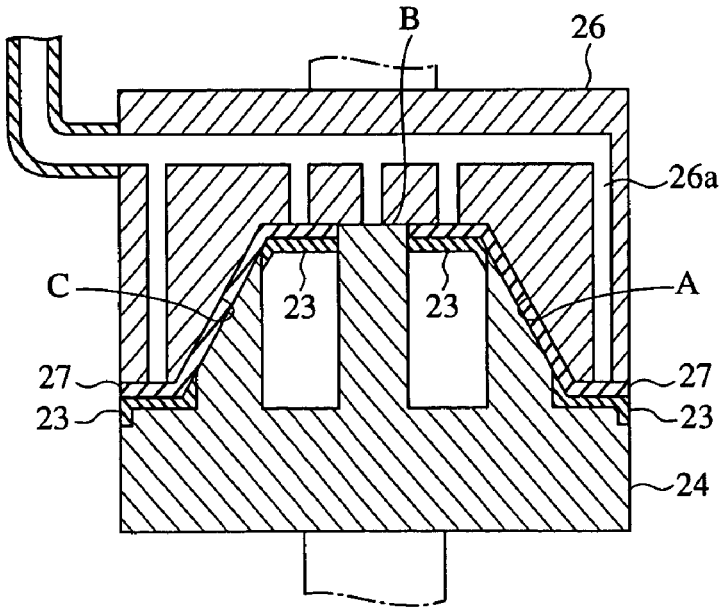
FIG. 4B is a cross sectional view of the upper half-mold and the lower half-mold in a state of both being engaged with each other.

Next, a method for manufacturing the loudspeaker system will be explained. FIG. 4A is a cross sectional view of the upper half-mold 26 and the lower half-mold 24 used in the paper-skimming process (a) performed using the apparatus shown in FIG. 3. FIG. 4B is a cross sectional view of the upper half-mold 26 and the lower half-mold 24 in a state of both being engaged with each other.

With the paper-skimming process (a), firstly, the paper-skimming bath 20 accommodating the liquefied paper material 23 locates at a position lower than the paper-skimming bath 21 due to an up-and-down controlling means such as hydraulic cylinders as not shown in the figure. Next, the upper half-mold 26 is lowered within the paper-skimming bath 21 due to the hydraulic cylinder 28 as shown in FIG. 4A. Upper faces 25A, 25B and 25C of the projection 25 of the lower half-mold 24 are then engaged with a lower face of the metal-screen mold 27 mounted on the upper half-mold 26, and make contact with a lower face of the upper half-mold 26 as shown in FIG. 4B.

In this state, the paper-skimming bath 20 is lifted to a predetermined position due to the up-and-down controlling means. The liquefied paper material 23 in the paper-skimming bath 20 then flows into the paper-skimming bath 21 through the paper-material supply pipe 22. A level of the liquefied paper material 23 in the bath 21 elevates to immerse the lower half-mold 24 and the upper half-mold 26 in a state of both being engaged with each other in the liquefied paper material 23. At this time, the stop valve 32*b* is opened, and the conduit 26*a* of the upper half-mold 26 is then aspirated through the metal-screen mold 27 due to the vacuum pump 32*c*. As a result, the liquefied paper material 23 adheres to the metal-screen mold 27, except for regions including contact faces A, B and C between the projections 25 of the lower half-mold 24 and the upper half-mold 26.

Figure 5:
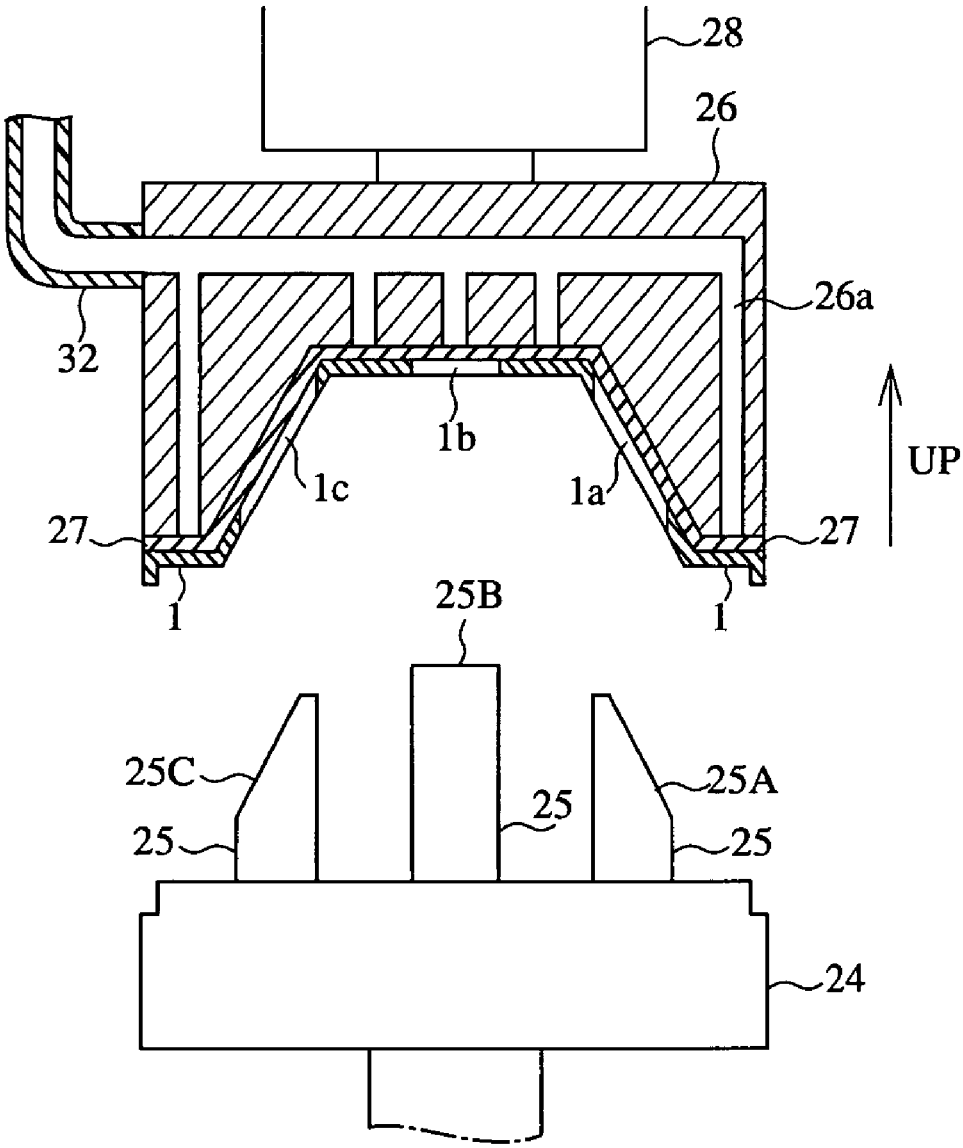
FIG. 5 is a cross sectional view of the upper half-mold shown in FIG. 4A in a state of liquefied paper material adhering to the upper half-mold.

Next, the paper-skimming bath 20 is lifted due to the up-and-down controlling means to lower the level of the liquefied paper material 23 in the bath 21. Alternatively, the upper half-mold 26 is lifted due to the hydraulic cylinder 28. While doing so, the aspiration is kept through the metal-screen mold 27. 45% to 50% of water content in the liquefied paper material 23 adhered to the metal-screen mold 27 is aspirated. FIG. 5 is a cross sectional view of the upper half-mold 26 shown in FIG. 4A in a state of liquefied paper material 23 adhering to the upper half-mold 26. As a result, a paper frame member 1 is paper-skimmed and formed, and holes 1*a*, 1*b* and 1*c* are made at the regions including contact faces A, B and C between the projections 25 and the upper half-mold 26. The holes 1*a* and 1*c* are made for use in releasing air pressure, and the hole 1*b* is a central hole for use in voice coils.

Moreover, eight holes, in total, for use in releasing air pressure, which include the holes 1*a* and 1*c*, are made concentrically at the paper frame member 1. Four mounting holes are further made at the paper frame member 1. Therefore, although these holes are not illustrated in the cross sectional view of FIG. 4B, the projections 25 are so made as to make contact with positions, which face the holes, of the upper half-mold 26.

With the skimmed paper-receiving process (b), the aspiration due to the vacuum pump 32*c* is stopped, and the paper frame member 1 is moved from the upper half-mold 26 to the carrying lower half-mold 33. Next, due to carry of the carrying lower half-mold 33, the paper frame member 1 is shifted to the water-removing lower half-mold 34 in the water-removing, forming process (c). Next, the water-removing upper half-mold 35 is so lowered due to the hydraulic cylinder 36 as to sandwich and compress the paper frame member 1 between the water-removing lower half-mold 34 and the water-removing upper half-mold 35. At the same time, the stop valve 31*d* is opened, and water content in the paper frame member 1 is so removed through the drainpipe 31*a* due to the vacuum pump 31*c* as to reduce to approximately 30%.

Next, the paper frame member 1 is shifted to the hot-disk lower half-mold 37 in the hot forming process (d). Next, the hot-disk upper half-mold 38 is so lowered due to the hydraulic cylinder 39 as to sandwich the paper frame member 1 between the hot-disk lower half-mold 37 and the hot-disk upper half-mold 38. The paper frame member 1 is compressed and heated due to the heater 37*a* of the hot-disk lower half-mold 37 and the heater 38*a* of the hot-disk upper half-mold 38. At the same time, the stop valve 31*e* is opened, and steam generated from the paper frame member 1 due to the heating is aspirated (de-watered) through the drainpipe 31*a* due to the vacuum pump 31*c*. In other words, the paper frame member 1 is dried. After drying the paper frame member 1, the hot-disk upper half-mold 38 is lifted up due the hydraulic cylinder 39.

Next, when shifting to the product-removing process (e), the adsorption upper half-mold 40 is lowered due to the hydraulic cylinder 41 to bring the adsorption upper half-mold 40 into contact with the paper frame member 1 placed on the hot-disk lower half-mold 37. The stop valve 32*d* of the drainpipe 32*a* is then opened, and the paper frame member 1 is attached to the adsorption upper half-mold 40 due to the aspiration of the vacuum pump 32*c*. At the same time, the stop valve 31*e* of the drainpipe 31*a* is opened, and the paper frame member 1 is separated from the hot-disk lower half-mold 37 due to the injection of the vacuum pump 31*c*. The adsorption upper half-mold 40 adsorbing the paper frame member 1 is then lifted up due to the hydraulic cylinder 41. Next, when shifting to the product-accommodating process (f), the adsorption upper half-mold 40 adsorbing the paper frame member 1 is moved, and the stop valve 32*d* of the drainpipe 32*a* is opened. The paper frame member 1 is separated from the adsorption upper half-mold 40 due to the injection of the vacuum pump 32*c*, and is housed at a predetermined position.

Therefore, the apparatus for manufacturing the paper frame member as shown in FIG. 3 includes a first controlling means (hydraulic cylinder 28 and other) bringing the projection 25 of the lower half-mold 24 into contact with the forming surface of the upper half-mold 26, a second controlling means (up-and-down controlling means and other as not shown) controlling an adhesion of the liquefied paper material 23 to a section other than a section making contact with the projection 25 in the forming surface of the upper half-mold 26, a third controlling means (vacuum pump 32*c* and other) removing water from the liquefied paper material 23 adhered to the forming surface of the upper half-mold 26, and fourth controlling means (heaters 37*a*, 38*a* and power controllers as not shown) heating and drying the paper material de-watered to form the paper frame member 1.

Figure 6A:
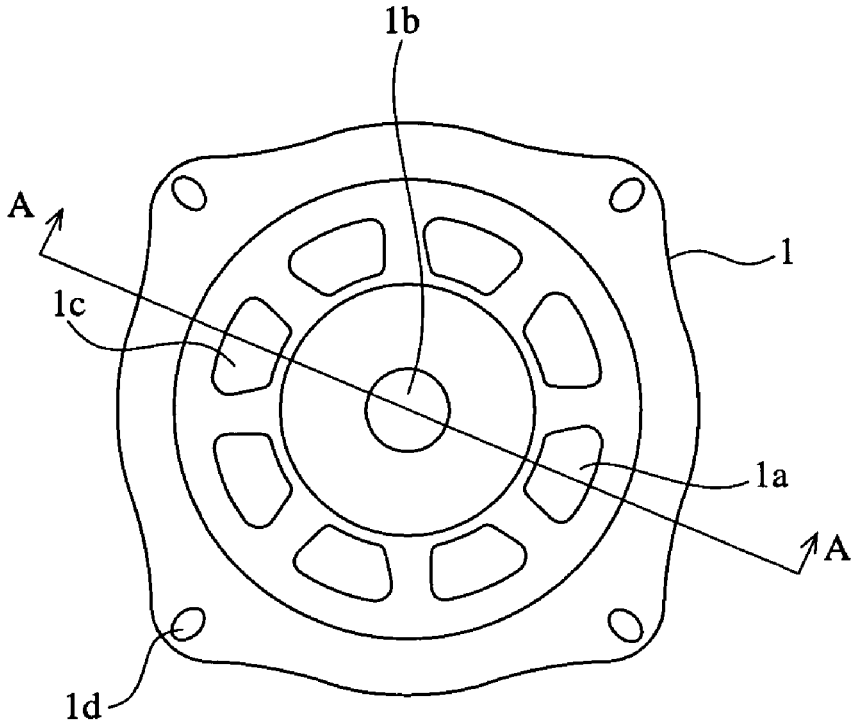
FIG. 6A is a plan view of a paper frame member paper-skimmed and formed in the apparatus shown in FIG. 3.

FIG. 6A is a plan view of a paper frame member paper-skimmed and formed in the apparatus shown in FIG. 3. FIG.

Figure 6B:
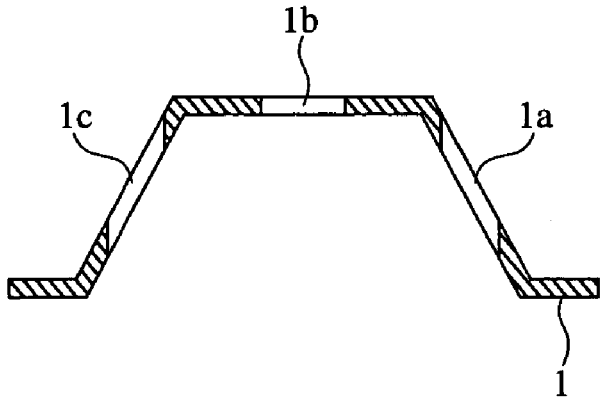
FIG. 6B is a cross sectional view taken along lines A—A of FIG. 6A.

6B is a cross sectional view taken along lines A—A of FIG. 6A. As shown in FIG. 6A, eight holes, in total, including the central hole 1*b* for use in voice coils, the holes 1*a* and 1*c*, are formed at the paper frame member 1 finished. Four mounting holes are further formed at the paper frame member 1. A cross sectional profile of the paper frame member 1 shown in FIG. 6B corresponds to a cross sectional profile of the paper frame member 1 shown in FIG. 5.

The frame member of the loudspeaker system manufactured in paper-skimming and forming process allows remarkable reduction of self-resonance frequency. In this way, it is possible to provide a loudspeaker system having the outstanding acoustic characteristics without loss of sound quality because of self-resonance of the frame member occurred due to vibration of the vibrating plate.

For example, with 13 cm-bore loudspeaker system using a paper frame member in 2 mm thickness, the self-resonance frequency thereof is reduced to 250 Hz range.

Since the magnetic flux is not leaked from the magnetic circuits, it is possible to provide a high-efficiency loudspeaker system.

Since the paper frame member facilitates to separate from another parts, it is possible to provide a cost-reduction loudspeaker system which facilitates to separate from parts when the loudspeaker system is disposed.

For example, when the loudspeaker system is heated entirely to the ignition temperature of paper, it is possible to burn only the paper frame member to remove metal materials separated from the paper frame member. In this way, it is possible to reduce the cost of discarding and disposing the system. Alternatively, when the loudspeaker system in all is left in water for a predetermined period of time, the paper frame member is changed to a pulping solvent. In this way, it is possible to remove metal materials separated from another materials and to reduce the cost of discarding and disposing the system. Alternatively, when separated metal materials such as magnets is reused and only the paper frame member is wasted in soil, the paper frame member is decomposed perfectly due to bacteria in soil during a short period of time as in the case of lumber. Therefore, it is possible to reduce environmental loads.

As described above, the method for manufacturing the paper frame member is furthermore performed simply as compared with methods for manufacturing metal or resin made frame member, without preparing expensive facilities such as press machines and stamping dies, using inexpensive materials. In this way, it is possible to provide an inexpensive loudspeaker system manufactured at a low cost.

Moreover, with the method for manufacturing the paper frame member in the embodiment 1, the metal-screen mold 27 is mounted on the upper half-mold 26 in the paper-skimming process (a). Alternatively, a metal-screen mold may be mounted on a convex-shaped lower half-mold, and projections may be arranged on an upper half-mold. In such a case, similarly paper-skimmed and formed paper frame member is formed at a section other than the projections making contact with the lower half-mold in the forming surface of the upper half-mold. With a water-removing process of this case, the stop valve 31*b* in FIG. 3 is opened, and the liquefied paper material 23 adhered to the metal-screen mold of the lower half-mold is de-watered through the drainpipe 31*a* due to the aspiration of the vacuum pump 31*c*.

As described above, according to the embodiment 1, it is possible to reduce self-resonance frequency of the paper frame member to a level extreme lower than the range of human hearing. In this way, it is possible to provide a loudspeaker system having the outstanding acoustic characteristics without loss of sound quality because of self-resonance of the frame member occurred due to vibration of the vibrating plate. It is further possible to provide a high-efficiency loudspeaker system because the magnetic flux is not leaked from the magnetic circuits. It is possible to provide a cost-reduction loudspeaker system facilitating to separate from parts when the loudspeaker system is disposed because the paper frame member facilitates to separate from another metal materials. It is possible to provide an inexpensive loudspeaker system manufactured at a low cost of materials and paper skimming and forming process of the paper frame member.

According to the embodiment 1, the apparatus for manufacturing the loudspeaker system includes the paper-skimming bath 20 (the first accommodation means) accommodating liquefied paper material 23, the paper-skimming bath 21 (a second accommodation means) accommodating the upper half-mold 26 and the metal-screen mold 27 (a frame-forming mold) and the lower half-mold 24 and the projection 25 (an auxiliary mold), the paper-material supply pipe 22 (a communication pipe) connecting the paper-skimming bath 20 to the paper-skimming bath 21, and the up-and-down controlling means raising or lowering the paper-skimming bath 20. In this way, the up-and-down movement of the paper-skimming bath 20 due to the up-and-down controlling means changes vertically the level of the liquefied paper material 23 in the paper-skimming bath 21 accommodating the upper half-mold 26, the metal-screen mold 27, the lower half-mold 24 and the projection 25. Therefore, it is possible to control easily a process of the liquefied paper material 23 adhering to the upper half-mold 26, the metal-screen mold 27, the lower half-mold 24 and the projection 25. As a result, since a time period of performing the paper-skimming process is reduced, it is possible to provide an inexpensive loudspeaker system manufactured at a low cost.

Embodiment 2

Figure 7:
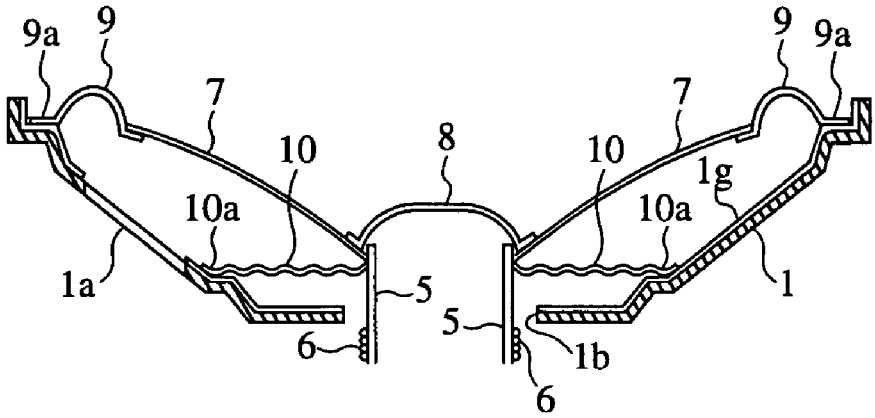
FIG. 7 is a cross sectional view of a part of a loudspeaker system as embodiment 2 according to the invention.

FIG. 7 is a cross sectional view of a part of a loudspeaker system as embodiment 2 according to the invention. In the figure, a reference numeral 1 denotes a paper frame member, which is paper-skimmed and formed as in the case of the embodiment 1. A reference numeral 1*a* denotes an air-discharging hole of the paper frame member 1, 1*b* denotes a central hole for use in voice coils of the paper frame member 1, and 1*g* denotes a resin film arranged on a surface of the paper frame member 1. A reference numeral 5 denotes a bobbin, which is inserted into the central hole 1*b* of the paper frame member 1, 6 denotes a voice coil wound around the bobbin 5, 7 denotes a vibrating plate, and 8 denotes a center cap of the vibrating plate 7. A reference numeral 9 denotes an edge of thermoplastic resin materials such as polyurethane forms, and 9*a* denotes an outer periphery of the edge 9, which is welded to the outer periphery of the paper frame member 1. A reference numeral 10 denotes a damper member mixed with thermoplastic resin fibers, and 10*a* denotes an outer periphery of the damper member 10, which is welded to the paper frame member 1.

With the embodiment 2, 1*g* of the resin film is laminated (label-treated) on one side of the paper frame member 1 due to surface-treatment means (not shown) in accordance with the manufacturing method shown in FIG. 3. Resins used in lamination process include polypropylene resins, polyethylene resins, and polyethylene terephthalate resins, for example.

The lamination process results in improved moisture-proof property and waterproof property. For example, the loudspeaker system for use in mounting on the vehicle is subjected to environments such as rainwater or condensation as compared with one for use in placing in a room. Therefore, the lamination-processed surface of the paper frame member results in protection of the loudspeaker system from the environments such as rainwater or condensation.

The lamination process results in improved stiffness of the frame member. Therefore, it is possible to provide a reliable loudspeaker system as in the case of metal or resins made frame member. In other words, since the lamination of 1*g* of the resin film results in forming a layer of skin (shell) on a surface of the paper frame member 1, it is possible to improve twisting stiffness thereof. Accordingly, even if the vibrating plate 7 and the bobbin 5 are deviated from the respective axes in linear motion to rub the voice coil 6 with upper plates made of magnetic materials, electrical breakdowns are not entirely produced. Therefore, it is possible to manufacture a reliable loudspeaker system having high strength using the paper frame member.

The lamination process results in welding easily the paper frame member with another parts without using adhesives. In other words, after the outer periphery 9*a* of the edge 9 is overlaid on 1*g* of the resin film, an ultrasonic vibrator (horn) is applied thereon to weld the edge 9 with the paper frame member 1. Likewise, after the outer periphery 10*a* of the damper member 10 is overlaid on 1*g* of the resin film, the ultrasonic vibrator is applied thereon to weld the damper member 10 with the paper frame member 1.

As described above, with a production line of the system, management of amount of adhesives used, management of adhesive-setting time periods, and adhesives-using process requiring measures of blocking smell such as organic solvents contained in the adhesives are not entirely needed. In this way, it is possible to provide an inexpensive loudspeaker system manufactured at a low cost. Moreover, since welding process can be performed, it is possible to provide a loudspeaker system having a high degree of flexibility in design of the system.

Moreover, with the embodiment 2, 1 g of the resin film is laminated on one side of the paper frame member 1. The film may be laminated on the other side thereof. In such a case, the same effect as the embodiment 1 is obtained. Alternatively, the lamination process may be performed on the both of sides of the paper frame member 1. In such a case, effects, which is higher than the embodiment 1, are obtained.

As described above, with the embodiment 2, it is possible to protect the loudspeaker system from environments such as rainwater or condensation due to the surface treatment using resin films. Furthermore, the surface treatment using the resin films results in increasing mechanical strength of the paper frame member to prevent the voice coil 6 from deviating from axis thereof on vibration. Therefore, since the voice coil 6 is not entirely rubbed with another parts and accordingly the electrical breakdown is not produced, it is possible to provide a loudspeaker system with a high degree of reliability. Furthermore, since the paper frame member is connected easily to another parts made from resin material due to a welding process, it is possible to provide an inexpensive loudspeaker system manufactured at a low cost. Since the paper frame member is connected easily to another parts made from resin material due to a welding process and accordingly complex designs of connection are not required, it is possible to provide a loudspeaker system having a high degree of flexibility in design of the system.

Embodiment 3

Figure 8:
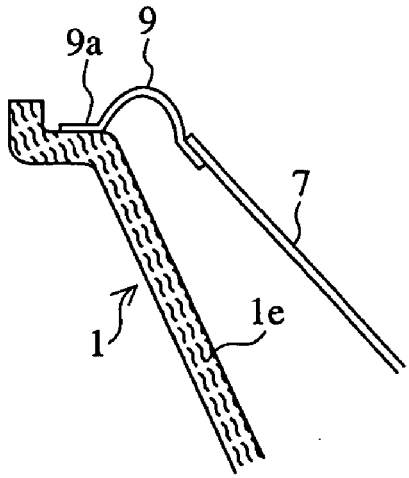
FIG. 8 is a cross sectional view of a part of a loudspeaker system as embodiment 3 according to the invention.

FIG. 8 is a cross sectional view of a part of a loudspeaker system as embodiment 3 according to the invention. The same components of the embodiment 3 as those of the embodiment 2 are indicated by the common marks and the explanation will be omitted. In the figure, a reference numeral 1*e* denotes thermoplastic resin fibers mixed into the paper frame member 1. A method for manufacturing the paper frame member 1 is common to the method in the embodiment 1, except that the thermoplastic resin fibers 1*e* are mixed into a liquefied paper material for use in paper-skimming and forming the paper frame member 1.

With the concrete method for manufacturing the loudspeaker system, the thermoplastic resin fibers 1*e* made of short-length fibers called staples are mixed into the liquefied paper materials. Both of materials are then stirred due to control of a stream of water in order to ensure the uniform dispersion of the resin fibers 1*e*. After stirring, the liquefied paper materials mixed with the resin fibers 1*e* are supplied to the paper-skimming bath 20 in FIG. 3. Processes from the process above are the same as the embodiment 1.

Therefore, the uniform dispersion of the resin fibers 1*e* results in entanglement of the resin fibers 1*e* with pulp fibers, and accordingly the mechanical strength is reinforced. In this way, it is possible to provide a reliable loudspeaker system as in the case of metal or resins made frame member.

Since surfaces of the paper frame member 1 containing the resin fibers 1*e* has the heat-solubility, it is possible to weld easily the paper frame member 1 with another parts without using the adhesives as in the case of the embodiment 1. Moreover, with the embodiment 3, the lamination process is not needed after forming the paper frame member 1. Therefore, it is possible to provide a stepped-up inexpensive loudspeaker system manufactured at a cost lower than ever. With the embodiment 3, since it is possible to perform the welding process, the loudspeaker system has a high degree of flexibility in design thereof.

Moreover, with the embodiment 3, when the resin fibers for mixing into the liquefied paper materials is so finished in the shape of a letter S or Z instead of the linear shape, the way in which the pulp fibers are entangled is further enhanced.

As described above, according to the embodiment 3, the mixing of resin fibers into the liquefied paper materials results in increasing mechanical strength of the paper frame member to prevent the voice coil 6 from deviating from axis thereof on vibration. Therefore, since the voice coil 6 is not entirely rubbed with another parts and accordingly the electrical breakdown is not produced, it is possible to provide a loudspeaker system with a high degree of reliability. With the embodiment 3, since the lamination process is not needed after the forming process, it is possible to provide an inexpensive loudspeaker system manufactured at a low cost. Since the paper frame member is connected easily to another resin parts due to the welding process and accordingly complex designs of connection are not required, it is possible to provide a loudspeaker system having a high degree of flexibility in design of the system.

Embodiment 4

Figure 9:
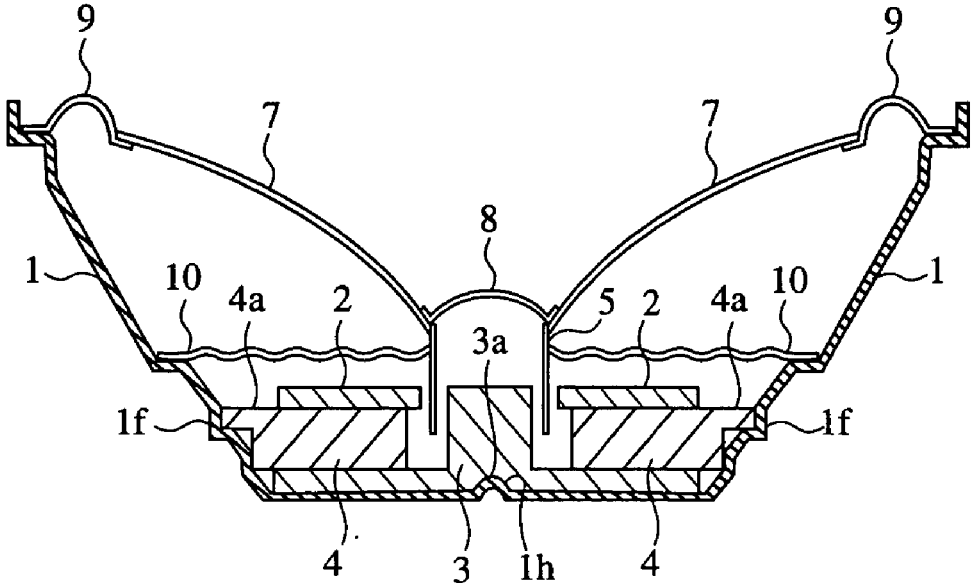
FIG. 9 is a cross sectional view of a loudspeaker system as embodiment 4 according to the invention.

FIG. 9 is a cross sectional view of a loudspeaker system as embodiment 4 according to the invention. The same components of the embodiment 4 as those of the embodiment 2 are indicated by the common marks and the explanation will be omitted. In the figure, a reference numeral 2 denotes an upper plate, 3 denotes a pole-piece, 3*a* denotes a positioning recess of the pole-piece 3, 4 denotes a disk-shaped resin magnet containing thermoplastic resin fibers, and 4*a* denotes a section for welding of the resin magnet 4. A reference numeral 1*f* denotes a welding section of the paper frame member 1, and 1*h* denotes a positioning projection of the paper frame member 1. The paper frame member 1 of the embodiment 4 is lamination-processed with the thermoplastic resin film used in the embodiment 2, alternatively mixed with the thermoplastic resin fibers used in the embodiment 3, and allows welding easily with another resin parts.

Next, a method for manufacturing the loudspeaker system will be explained.

The resin magnet 4 is sandwiched between the upper plate 2 and the pole-piece 3. The positioning projection 1*h* of the paper frame member 1 is engaged with the positioning recess 3*a* of the pole-piece 3, and the paper frame member 1 is bonded to the pole-piece 3. The welding section 4*a* of the disk-shaped resin magnet 4 is brought into intimate contact with the welding section 1*f* of the paper frame member 1. The ultrasonic vibrator is tapped on the intimate contact section to weld the resin magnet 4 with the paper frame member 1.

As described above, according to the embodiment 3, the connection between the paper frame member and the resin magnet is performed due to the welding process at a short time period. In this way, it is possible to provide an inexpensive loudspeaker system manufactured at a low cost due to reduction of time period of manufacturing the products. Moreover, since the paper frame member is connected easily to the resin magnet due to the welding process and accordingly complex designs of connection are not required, it is possible to provide a loudspeaker system having a high degree of flexibility in design of the system.

Embodiment 5

Figure 10:
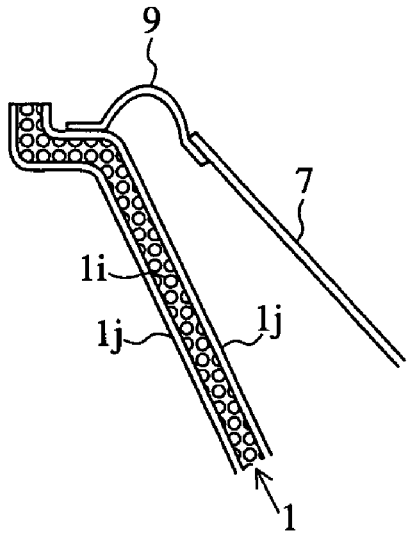
FIG. 10 is a cross sectional view of a part of a loudspeaker system as embodiment 5 according to the invention.

FIG. 10 is a cross sectional view of a part of a loudspeaker system as embodiment 5 according to the invention. The same components of the embodiment 5 as those of the embodiment 2 are indicated by the common marks and the explanation will be omitted. In the figure, a reference numeral 1*i* denotes a paper material for use in a foaming layer constituting the paper frame member 1, and 1*j* denotes a skin layer arranged at a surface of the paper material 1*i* of the foaming layer. In order to paper-skim and form the paper frame member 1 in the foaming layer, a foaming agent is mixed previously into the liquefied paper materials, which will be supplied to the paper-skimming bath 20 in FIG. 3. The foaming agent in the mixture is reacted due to the compression and application of heat in the hot-forming process (d) to accelerate the foaming reaction.

The paper frame member 1 of the foaming layer has coarse tissues forming in an infinite number of cavities. Therefore, since air contained in the cavities reduces speed of sound wave propagation, it is possible to reduce self-resonance frequency thereof. In this way, it is possible to provide a loudspeaker system having the outstanding acoustic characteristics without loss of sound quality because of self-resonance of the frame member occurred due to vibration of the vibrating plate. Moreover, the skin layer 1*j* formed on the surface of the paper material 1*i* results in improved stiffness of the frame member, and is effective at achieving a sufficient strength of the loudspeaker system. Furthermore, since the foaming of the material per se results in reduction of cost of materials and in improvement of productive efficiency, it is possible to provide an inexpensive loudspeaker system manufactured at a low cost.

As described above, according to the embodiment 5, it is possible to reduce self-resonance frequency of the foam-making paper frame member to a level extreme lower than the range of human hearing. In this way, it is possible to provide a loudspeaker system having the outstanding acoustic characteristics without loss of sound quality because of self-resonance of the frame member occurred due to vibration of the vibrating plate. Moreover, the skin layer formed on the surface of the paper material results in achieving a sufficient strength of the loudspeaker system. Furthermore, since the foam-making treatment and the hot-forming process are performed at the same time, it is possible to provide an inexpensive loudspeaker system manufactured at a low cost.

Embodiment 6

Figure 11:
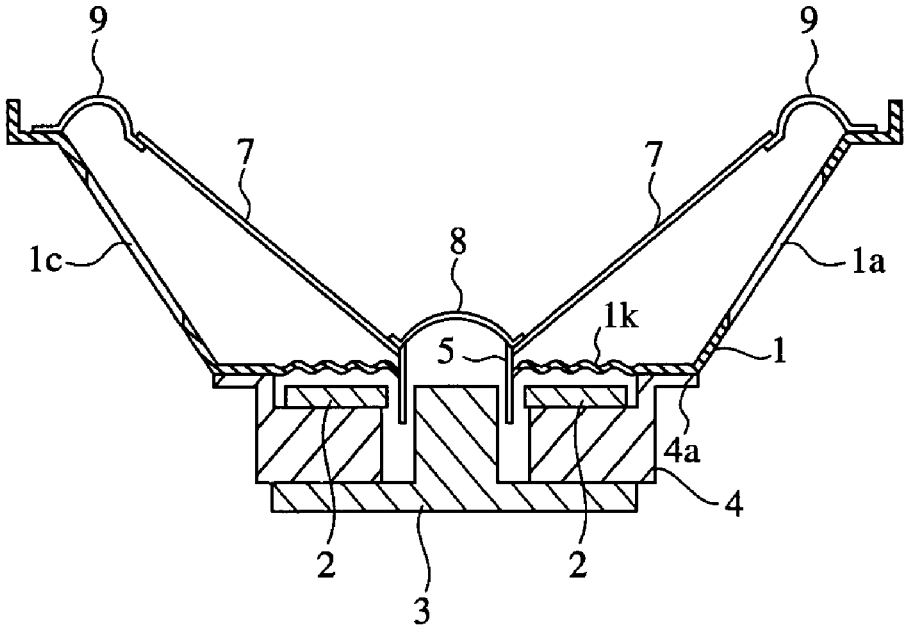
FIG. 11 is a cross sectional view of a loudspeaker system as embodiment 6 according to the invention.

FIG. 11 is a cross sectional view of a loudspeaker system as embodiment 6 according to the invention. The same components of the embodiment 6 as those of the embodiment 5 are indicated by the common marks and the explanation will be omitted. In the figure, a reference numeral 1*k* denotes a damper section formed in one piece together with the paper frame member 1. The resin film is lamination-processed on the surface of the paper frame member 1 although it is not shown in the figure.

Figure 12:
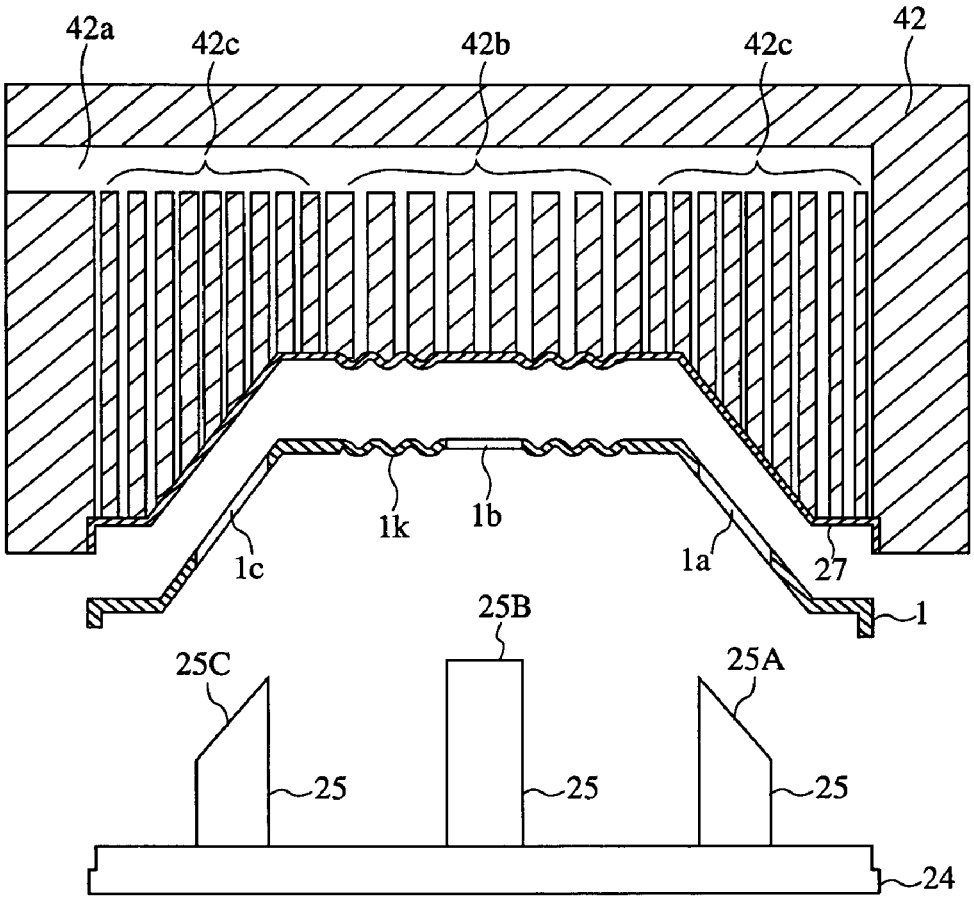
FIG. 12 is a cross sectional view of an upper half-mold and a lower half-mold used to skim and form a paper frame member used in a loudspeaker system as the embodiment 6 according to the invention.

FIG. 12 is a cross sectional view of an upper half-mold and a lower half-mold used to skim and form a paper frame member used in a loudspeaker system as the embodiment 6 according to the invention. The figure shows a configuration of forming the paper frame member 1 formed in one piece together with the damper section 1*k*. In the figure, a reference numeral 42 denotes a paper-skimming upper half-mold (frame-forming mold), and 42*a* denotes a conduit as in the case of the conduit 26*a* of the upper half-mold 26 in the embodiment 1: A reference numeral 42*b* denotes sub-conduits arranged at a central section of the mold 42 to lead the conduit 42 to the metal-screen mold 27, and 42*c* denotes sub-conduits arranged at an outer periphery of the central section of the mold 42. The peripheral sub-conduits 42*c* have holes at densities higher and internal diameter smaller than the central sub-conduits 42*b*. The residual configuration is the same as the embodiment 1, and the common components are indicated by the common marks.

Next, a method for manufacturing the loudspeaker system will be explained.

The liquefied paper materials are adhered to the metal-screen mold 27 mounted on the upper half-mold 42 as in the case of the paper-skimming process (a) in the embodiment 1. In such a case, the upper faces 25A, 25B and 25C of the projections 25 of the lower half-mold 24 (auxiliary mold) bring into contact with the upper half-mold 42 as in the case of the embodiment 1. Therefore, the air-release holes 1*a*, 1*c* and the central hole 1*b*, which is used for the voice coil, are formed in the paper frame member 1 to be molded.

Since the sub-conduits 42*c* making contact with the metal-screen mold 27 have holes at high densities and small internal diameters, it is possible to form the paper frame member 1 having a thickened outer periphery as shown in the figure. On the other hand, since the sub-conduits 42*b* have holes at low densities and large internal diameters, a central section or the damper section 1*k* is thinned with wavy shape in cross section. Moreover, after the product-accommodating process (f) in FIG. 3, the resin film is lamination-processed on a surface of a projected side of the paper frame member 1 (side of the metal-screen mold 27 in FIG. 3).

When assembling the loudspeaker system using the paper frame member 1, the ultrasonic vibrator is tapped on the welding section 4*a* of the resin magnet 4 to weld the resin magnet 4 with the paper frame member 1. The bobbin 5 is inserted into a central hole of the damper section 1*k* of the paper frame member 1 and is adhered to the central hole.

Since the damper section 1*k* and the paper frame member 1 are formed in one piece, a process of adhering a damper member to the paper frame member 1 is omitted. In this way, it is possible to provide an inexpensive loudspeaker system manufactured at a low cost. Furthermore, the damper section 1*k* of the paper frame member 1, which is thinned with wavy shape in cross section, has elasticity following flexibility on the vibration of the vibrating plate 7. The stiffness of the paper material skimmed and formed results in having the function of braking vibration of the vibrating plate 7.

Moreover, the loudspeaker system in the embodiment 6 is comprised of the paper frame member whose surface is lamination-processed with the resin film. Alternatively, the loudspeaker system may be comprised of a paper frame member, which is paper-skimmed and formed using liquefied paper materials mixed with thermoplastic resin fibers. In such a case, since the damper section has strength enough to overcome mechanical fatigue occurred due to the vibration, it is possible to provide a long wearing loudspeaker system.

As described above, according to the embodiment 6, since a process for manufacturing the damper member is decommissioned, it is possible to provide an inexpensive loudspeaker system manufactured at a low cost. Moreover, since the design of the damper member is not required in isolation, it is possible to provide a loudspeaker system having a high degree of flexibility in design of the system.

Embodiment 7

Figure 13A:
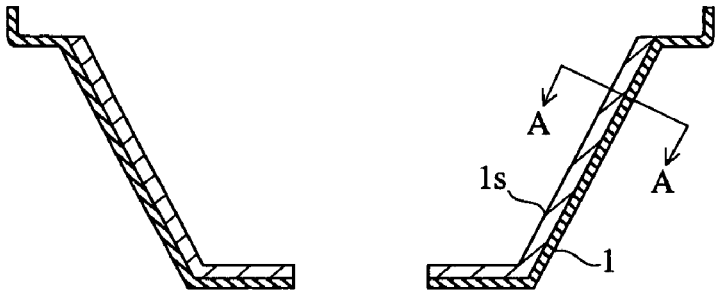
FIG. 13A is a cross sectional view of a paper frame member used in a loudspeaker system as embodiment 7 according to the invention.
Figure 13B:
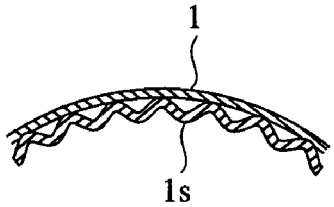
FIG. 13B is a cross sectional view taken along lines A—A of FIG. 13A.

FIG. 13A is a cross sectional view of a paper frame member used in a loudspeaker system as embodiment 7 according to the invention, and FIG. 13B is a cross sectional view taken along lines A—A of FIG. 13A. In the figures, a reference numeral 1*s* denotes a reinforced frame (reinforced member) mounted on one side (inner surface) of the paper frame member 1. The reinforced frame 1*s* is bonded to the paper frame member 1 after skimming and forming process. In other words, the reinforced frame 1*s* has wavy shape in cross section as in the case of a center core of corrugated cardboard, and tops of the wave are bonded to surfaces of the paper frame member 1 using adhesives. The bonding process is performed due to adherent treatment means as not shown.

Thus, the bonding of the reinforced frame 1*s* to the surface of the paper frame member 1 results in improved stiffness of the paper frame member 1. When the paper frame member 1 is subjected to external force, axis of the vibrating plate reduces its tendency to deviate from a center thereof without occurrence of distortion and loss of sound quality. Since the vibrating plate and the bobbin are not twisted in linear motion, the voice coil 6 is not rubbed with upper plates made of magnetic materials. As a result, electrical breakdowns are not entirely produced. Therefore, it is possible to manufacture a reliable loudspeaker system having high strength using the paper frame member. Since the frame member is comprised of a plurality of paper materials, it is possible to disperse the self-resonance frequencies as compared with a frame member made of a single paper material, and reduce a sound pressure level of noise generated due to the respective self-resonance frequencies. In this way, it is possible to provide a loudspeaker system having the outstanding acoustic characteristics without loss of sound quality.

Moreover, with the embodiment 7, no mention is made of materials of the reinforced frame 1*s*. Here, the reinforced frame 1*s* is not always made of the same materials as the paper frame member 1. For example, the reinforced frame, which is mixed with thermoplastic resin fibers, may be bonded to the paper frame member. Alternatively, the reinforced frame, which is mixed with the foaming agents and is subjected to the hot forming process, may be bonded to the paper frame member. Moreover, with the embodiment 7, the reinforced frame has a wavy shape. Alternatively, the wavy-shaped reinforced frame is not always used, and it is possible to use reinforced frames having any shape, for example flat, rectangular or trapezoidal shape, in accordance with objects of the system.

With the embodiment 7, the reinforced frame 1*s* is bonded to an inner face of the paper frame member 1. Alternatively, the reinforced frame 1*s* may be bonded to an outer face of the paper frame member 1. Furthermore, the reinforced frames may be bonded to the both sides of the paper frame member 1. In such a case, it is possible to further improve stiffness of the paper frame member.

As described above, according to the embodiment 7, it is possible to manufacture a reliable loudspeaker system having high strength using the paper frame member. Moreover, it is possible to disperse the self-resonance frequencies as compared with a frame member made of a single paper material, and reduce a sound pressure level of noise generated due to the respective self-resonance frequencies. In this way, it is possible to provide a loudspeaker system having the outstanding acoustic characteristics without loss of sound quality.

Embodiment 8

Figure 14A:
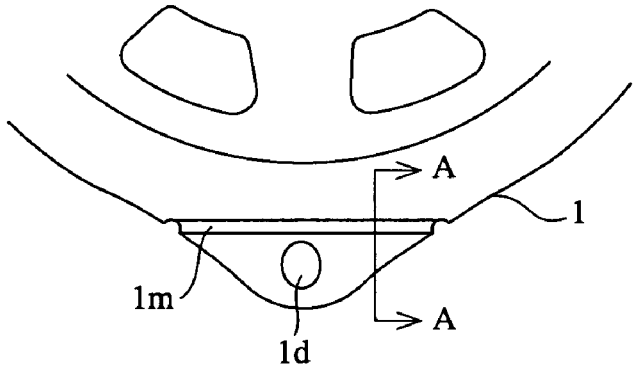
FIG. 14A is a plan view of a part of a paper frame member used in a loudspeaker system as embodiment 8 according to the invention.
Figure 14B:
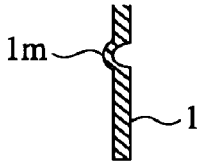
FIG. 14B is a cross sectional view taken along lines A—A of FIG. 14A.
Figure 14C:
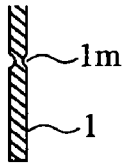
FIG. 14C is a cross sectional view taken along lines A—A of an alternative to the paper frame member of FIG. 14A.

FIG. 14A is a plan view of a part of a paper frame member used in a loudspeaker system as embodiment 8 according to the invention. FIG. 14B is a cross sectional view taken along lines A—A of FIG. 14A. FIG. 14C is a cross sectional view taken along lines A—A of an alternative to the paper frame member of FIG. 14A. In the figures, a reference numeral lm denotes a linear thinned section, which is arranged close to an edge of the paper frame member 1, and 1*d* denotes a mounting hole of the loudspeaker system. As shown in FIG. 14A, the linear thinned section lm is arranged close to the mounting hole 1*d*. The linear thinned section lm is thinner than other portions in cross section as shown in FIG. 14B. Alternatively, the linear thinned section lm may take on a structure as shown in FIG. 14C.

Thus, since the linear thinned section lm allowing bending of the paper frame member 1 is arranged near the mounting hole 1*d*, it is possible to bend a periphery of the mounting hole 1*d* with some flexibility on mounting the loudspeaker system on a curved section in vehicles for example. In this way, it is possible to prevent the paper frame member 1 from distortion on mounting because the linear thinned section lm absorbs the distortion. The mounted loudspeaker system is not uglified. Since the paper frame member 1 is not distorted, it is possible to provide a loudspeaker system having the outstanding acoustic characteristics without loss of sound quality. Since the periphery of the mounting hole 1*d* do not possess high stiffness as compared with metal or resin frame member, the paper frame member 1 is bent easily without using tools such as pliers. In this way, it is possible to reduce its tendency to subject to constraints of amounting position of the loudspeaker system and perform easily a mounting work.

As described above, according to the embodiment 8, it is possible to provide a loudspeaker system having the outstanding acoustic characteristics without loss of sound quality and without distortion of the paper frame member on mounting the system. Moreover, it is possible to reduce its tendency to subject to constraints of a mounting position of the loudspeaker system and perform easily a mounting work.

Embodiment 9

Figure 15A:
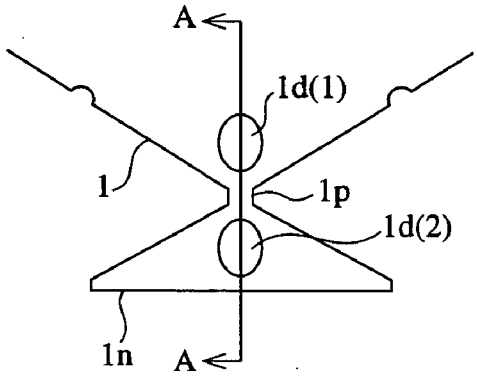
FIG. 15A is a plan view of a part of a paper frame member used in a loudspeaker system as embodiment 9 according to the invention.
Figure 15B:
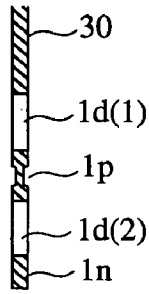
FIG. 15B is a cross sectional view taken along lines A—A of FIG. 15A.
Figure 15C:
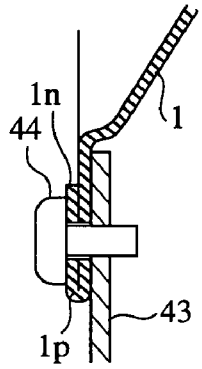
FIG. 15C is a partial sectioned view of the mounted loudspeaker system in FIG. 15A.

FIG. 15A is a plan view of a part of a paper frame member used in a loudspeaker system as embodiment 9 according to the invention. FIG. 15B is a cross sectional view taken along lines A—A of FIG. 15A. FIG. 15C is a partial sectioned view of the mounted loudspeaker system in FIG. 15A. In the figures, a reference numeral 1*p* denotes a thinned section allowing bending the paper frame member, and in denotes a folding region projected outwardly through the thinned section 1*p*. A reference numeral 1*d*(1) denotes a mounting hole formed at the inside of the thinned section 1*p*, and 1*d*(2) denotes a mounting hole formed at the outside of thinned section 1*p* or at the folding region 1*n*. A reference numeral 43 denotes a mounting member, and 44 denotes a mounting screw. The mounting hole 1*d*(1) and the mounting hole 1*d*(2) are symmetrical about the thinned section 1*p*.

The thinned section 1*p* allows bending of the paper frame member 1 through 180 degrees. In such a case, since the mounting hole 1*d*(1) and the mounting hole 1*d*(2) are symmetrical about the thinned section 1*p*, the two mounting holes 1*d*(1) and 1*d*(2) are overlaid one another when the folding region in is bent into 180 degrees.

Therefore, as shown in FIG. 15C, the paper frame member 1 is fixed to the mounting member 43 due to the mounting screw 44 passing through the two mounting holes 1*d*(1) and 1*d*(2) overlaid as a result of bending the folding region 1*n* into 180 degrees. In this way, since the folding region 1*n* has the function of working as a washer, it is possible to improve strength of force between the loudspeaker system and the mounting member.

Moreover, in such a case, the folding region ln is so constructed as to fold the paper frame member 1 into two leaves. Alternatively, in order to use a fanfold paper frame member, a plurality of folding regions, which are coupled to each other, may be formed and mounting holes may be formed at the respective folding regions. In such a case, since the folding regions 1*n* have the function of working as a washer, it is possible to further improve strength of force between the loudspeaker system and the mounting member.

As described above, according to the embodiment 9, since the folding region has the function of working as a washer of the mounting screw, it is possible to improve strength of force between the loudspeaker system and the mounting member using the paper frame member.

Embodiment 10

Figure 16:
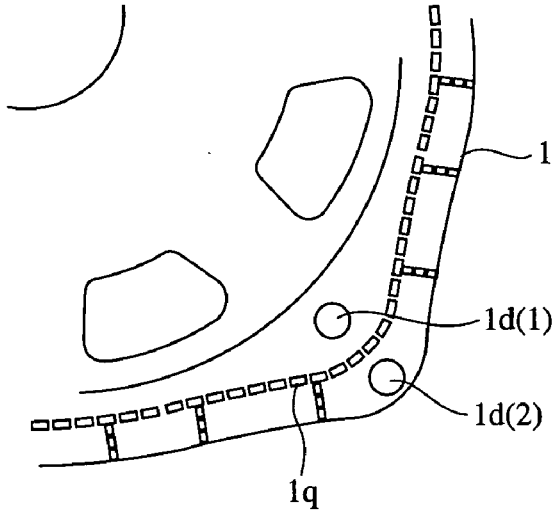
FIG. 16 is a plan view of a part of a paper frame member used in a loudspeaker system as embodiment 10 according to the invention.

FIG. 16 is a plan view of a part of a paper frame member used in a loudspeaker system as embodiment 10 according to the invention. In the figure, a reference numeral 1*q* denotes a plurality of pores (so-called tear-off holes) in a row, which are formed close to edges of the paper frame member 1. A reference numeral 1*d*(1) denotes a mounting hole formed inside of the pores 1*q* in a row or the center of the paper frame member 1, and 1*d*(2) denotes a mounting hole formed outside of the pores 1*q* or the edge side of the paper frame member 1. Since the pores 1*q* is so formed as to facilitate tearing off them using tools such as scissors, knives or the like, it is possible to divide the paper frame member into the edges and the center partitioned due to the pores 1*q*.

Therefore, when a part on which the loudspeaker system is mounted is not flat and has impediments such as various kinds of projections in the inside of vehicles for example, it is possible to tear off the regions, which are adequate for the impediments, of the paper frame member 1. In this way, it is possible to reduce its tendency to subject to constraints of a mounting position of the loudspeaker system and perform easily a mounting work. Moreover, it is possible to provide a loudspeaker system having the outstanding acoustic characteristics without loss of sound quality and without distortion of the paper frame member on mounting the system.

Thus, with the embodiment 10, when a part on which the system is mounted is not flat and has impediments or projections, it is possible to provide the system having the outstanding acoustic characteristics without loss of sound quality, without distortion of the paper frame member on mounting the system. Moreover, it is possible to reduce its tendency to subject to constraints of a mounting position of the loudspeaker system and perform easily a mounting work.

Moreover, the pores in a row, which are formed in the paper frame member 1, are not limited to the shape as shown in FIG. 6 and are formed in a shape adequate for uses of the loudspeaker system. In other words, the pores in rows are formed not only in concentric shapes but also in radial shapes, and in further complex shapes. In such a case, when a part on which the system is mounted is not flat and has impediments or projections, it is possible to provide the system having the outstanding acoustic characteristics without loss of sound quality, without distortion of the paper frame member on mounting the system. Moreover, it is possible to reduce its tendency to subject to constraints of a mounting position of the loudspeaker system and perform easily a mounting work.

Embodiment 11

Figure 17A:
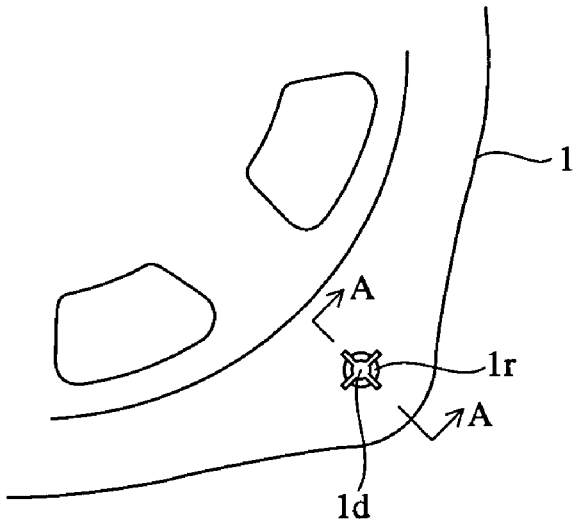
FIG. 17A is a plan view of a part of a paper frame member used in a loudspeaker system as embodiment 11 according to the invention.
Figure 17B:
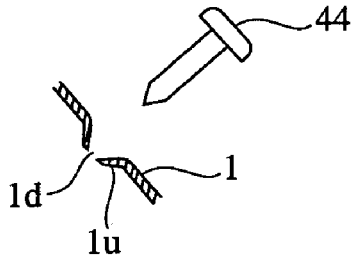
FIG. 17B is a cross sectional view taken along lines A—A of FIG. 17A.
Figure 17C:
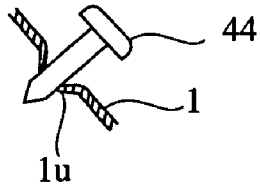
FIG. 17C is a cross sectional view taken along lines A—A of FIG. 17A when a mounting screw is inserted.

FIG. 17A is a plan view of a part of a paper frame member used in a loudspeaker system as embodiment 11 according to the invention. FIG. 17B is a cross sectional view taken along lines A—A of FIG. 17A. FIG. 17C is a cross sectional view taken along lines A—A of FIG. 17A when a mounting screw is inserted. In the figures, a reference numeral 1*r* denotes a cross-shaped slit formed at an inner periphery of the mounting hole 1*d* of the paper frame member 1, and 1*u* denotes a protrusion formed due to protruding the inner periphery of the mounting hole 1*d* toward the mounting plate side.

As shown in FIG. 17B, when the mounting screw 44 such as self-tapping screw is inserted into the mounting hole 1*d*, the bore of the mounting hole 1*d* is broadened due to the cross-shaped slit 1*r*. Simultaneously, since the protrusion 1*u* acts elastically on the inside of the periphery of the mounting hole 1*d*, it is possible to facilitate insertion of the mounting screw 44. As shown in FIG. 17C, after the mounting screw 44 is inserted into the mounting hole 1*d* once, the protrusion 1*u* acts stiffly on the outside the periphery of the mounting hole 1*d*. Therefore, the mounting screw 44 is not easily disconnected from the mounting hole 1*d*.

Therefore, it is possible for manufacturers of the loudspeaker system to ship the loudspeaker system in a state of fixing previously and provisionally the mounting screw 44 to the mounting hole 1*d* of the paper frame member 1. In such a case, it is possible for workers to discriminate whether the mounting screws 44 all are or not fixed provisionally. In this way, since a complicated process of counting the number of mounting screws 44 every time the loudspeaker systems are packed in boxes is not required, it is possible to provide an inexpensive loudspeaker system manufactured at a low cost.

With a vehicle-manufacturing line, when the loudspeaker system on which the mounting screws 44 are fixed provisionally is incorporated into the vehicle, the workers engaging in the assembly work are excepted from taking mounting screws out of boxes every time the loudspeaker systems are mounted on the vehicles. Moreover, it is possible to resolve mistakes made due to missing the mounting screws. Therefore, it is possible for the workers to avoid becoming physical or mental fatigue due to the screw-mounting work at established period of time and accordingly to perform a system-mounting work with efficiency.

As described above, according to the embodiment 11, since the mounting screws are handled in a state of mounting provisionally on the loudspeaker system, various manufacturing processes, which are performed when the mounting screws are handled in isolation, are not required. In this way, it is possible to provide an inexpensive loudspeaker system manufactured at a low cost. Moreover, it is possible to perform the system-mounting work with efficiency.

INDUSTRIAL APPLICABILITY

As described above, with a loudspeaker system, a method and an apparatus of manufacturing the same according to the invention, it is possible to reduce self-resonance frequency of a paper frame member to a level extreme lower than the range of human hearing. In this way, it is possible to provide a loudspeaker system having the outstanding acoustic characteristics without loss of sound quality because of self-resonance of the frame member occurred due to vibration of the vibrating plate.

What is claimed is:

1. A method of manufacturing a paper frame member for a loudspeaker system, comprising the steps of:

bringing an auxiliary mold having a masking pattern into contact with a portion of a forming surface in a frame-forming mold for paper-skimming and forming a frame member of a loudspeaker system;

supplying liquefied paper material, having a water content, for adhering to a section of the forming surface of the frame-forming mold corresponding to the masking pattern;

removing water from the liquefied paper material adhered to the forming surface of the frame-forming mold; and heating and drying the paper material to form a paper frame member.

2. A method of manufacturing a loudspeaker system according to claim 1, further comprising the step of mixing thermoplastic resin fibers into the liquefied paper material prior to the step of supplying.

3. A method of manufacturing a loudspeaker system according to claim 1, further comprising foaming the liquefied paper material which is made from foaming paper materials.

4. A method of manufacturing a loudspeaker system according to claim 1, wherein the supplying step comprising the steps of:

lifting a first accommodation means for accommodating the liquefied paper material, and feeding the liquefied paper material into a second accommodation means connected to the first accommodation means through a communication pipe to immerse the auxiliary mold and the frame-forming mold in the second accommodation means;

wherein the removing step comprises the steps of:

lowering the first accommodation means so that the liquefied paper material reaches a position lower than an adhering face defined by the liquefied paper material and the frame-forming mold; and removing water from the liquefied paper material adhered to the frame-forming mold.

5. An apparatus of manufacturing a paper frame member for a loudspeaker system, comprising:

a frame-forming mold for paper-skimming and forming a frame member of a loudspeaker system;

an auxiliary mold having a masking pattern;

a first controlling means for bringing the auxiliary mold into contact with a forming surface of the frame-forming mold;

a second controlling means for controlling an adhesion of liquefied paper material having a water content to a section in the forming surface of the frame-forming mold corresponding to the masking pattern;

a third controlling means for removing water from the liquefied paper material adhered to the forming surface of the frame-forming mold; and a fourth controlling means for heating and drying the paper material to form a paper frame member.

6. An apparatus of manufacturing a loudspeaker system according to claim 5, wherein the frame-forming mold and the auxiliary mold each have shape which are adequate for paper-skimming, and the frame member and a damper section, which brakes vibration of a vibrating plate in a loudspeaker system, may be formed in one piece.

7. An apparatus of manufacturing a loudspeaker system according to claim 5, further comprising:

a first accommodation means for accommodating liquefied paper material;

a second accommodation means for accommodating a frame-forming mold and an auxiliary mold;

a communication pipe for connecting the first accommodation means to the second accommodation means; and an up-and-down controlling means for raising or lowering the first accommodation means.

8. A method of manufacturing a paper frame member for a loudspeaker system, comprising:

contacting a first mold having a masking pattern with a second mold, the second mold including a frame-forming mold;

supplying a paper fluid to adhere to the frame-forming mold on portions corresponding to the masking pattern;

removing water from and drying said paper fluid to form a frame member for a loudspeaker system from said frame-forming mold.

9. The method of claim 8, wherein said contacting includes contacting said first mold with the second mold using a lifting device and a controller, and said supplying includes supplying the paper fluid using a first bath containing said paper fluid being raised relative to a second bath containing said first and second molds to supply said paper fluid to the second bath.

10. The method of claim 8, wherein said removing includes compressing said frame-forming mold between two molds to remove the water, and said drying includes compressing said frame-forming mold between two heated molds to dry the paper fluid.

11. An apparatus for manufacturing a frame member for a loudspeaker system, comprising:

at least one or more controllers for:

contacting a first mold having a masking pattern with a second mold, the second mold including a frame-forming mold;

supplying a paper fluid to adhere to the frame-forming mold on portions corresponding to the masking pattern;

removing water from and drying said paper fluid to form a frame member for a loudspeaker system from said frame-forming mold.

12. The apparatus of claim 11, wherein said frame member being formed to include thermoplastic resin fibers.

13. The apparatus of claim 11, wherein said frame member and a damper section for reducing vibration of a vibrating plate in the loudspeaker system being formed from one mold.

* * * * *